US008230765B1

(12) United States Patent
Cooley

(10) Patent No.: US 8,230,765 B1
(45) Date of Patent: Jul. 31, 2012

(54) TREE STEP INSTALLATION TOOL

(76) Inventor: Phil F. Cooley, Climax, MI (US)

( * ) Notice: Subject to any disclaimer, the term of this patent is extended or adjusted under 35 U.S.C. 154(b) by 323 days.

(21) Appl. No.: 12/611,469

(22) Filed: Nov. 3, 2009

(51) Int. Cl.
*B25B 13/48* (2006.01)

(52) U.S. Cl. ..... 81/176.15; 81/177.2; 81/44

(58) Field of Classification Search ..... 81/176.1, 81/176.15, 176.2, 119, 488, 901, 178.15, 81/44, 124.4, 177.2; 182/90–92
See application file for complete search history.

(56) References Cited

U.S. PATENT DOCUMENTS 1,503,323 A * 7/1924 Heasley ..... 81/488
2,437,762 A * 3/1948 Simonin ..... 81/119
3,802,300 A * 4/1974 Gillotti ..... 81/7.5
5,624,007 A 4/1997 Mahaffy
5,743,353 A 4/1998 Browning et al.
5,806,625 A 9/1998 Katz
5,899,124 A 5/1999 Cross, Jr.
6,729,437 B1 * 5/2004 Apple ..... 182/92
7,017,449 B1 3/2006 Ritchings
7,134,524 B2 * 11/2006 Sprague ..... 182/92
7,231,853 B1 6/2007 Burdge
7,258,045 B2 * 8/2007 Smith ..... 81/176.2

* cited by examiner

*Primary Examiner* — Hadi Shakeri
(74) *Attorney, Agent, or Firm* — Montgomery Patent & Design, LLC; Robert C. Montgomery; Joseph T. Yaksich

(57) ABSTRACT

A device which aids in the insertion and removal of tree steps within a tree, particularly during hunting, is herein disclosed, comprising an offset "L"-shaped crank with an upper end that has a hole which slips over the step portion of the tree step. An offset lower end of the crank comprises an outward facing rotating handle. To use the device, the user inserts a tree step into the tree using its pointed end, the device is slid over the step, and the step is cranked into the tree using the increased leverage provided by the device. Should the step need to be removed, the process is reversed by turning the device in a counter clockwise manner.

8 Claims, 7 Drawing Sheets

TREE STEP INSTALLATION TOOL

RELATED APPLICATIONS

The present invention was first described in a notarized Official Record of Invention on Dec. 16, 2008, that is on file at the offices of Montgomery Patent and Design, LLC, the entire disclosures of which are incorporated herein by reference.

FIELD OF THE INVENTION

The present invention relates generally to tree steps used in hunting to gain access to elevated perches in tree stands and the like, and in particular, to a device to aid in the installation and removal of such tree steps.

BACKGROUND OF THE INVENTION

Hunting is one of the most widespread and popular outdoors activities in the world. Many devices exist to assist, enhance, and enable the various types and aspects of hunting. In particular, it is often desirable to hunt game from an elevated position such as a tree stand or a blind. Most such locations are difficult to access, and thus tree steps are affixed to the trunk of the tree in order to allow the hunter stable, easy access to the desired perch.

The process of affixing and removing tree steps can be arduous. Many times, this can lead to an adverse effect on the outdoors experience. Steps take a long time to install properly, which can be problematic should the hunter desire to change locations quickly. Often, the steps will not be installed properly, or too few steps will be installed due to time constraints, or the steps may be left behind once installed in order to save the time spent in removing the steps. Accordingly, this has led to inefficiencies and problems with regards to the safety, cost, expediency, and environmental sensitivity of such endeavors.

Various attempts have been made to provide a device for the expedition of installing tree steps. Examples of these attempts can be seen by reference to several U.S. patents. U.S. Pat. No. 5,743,353, issued in the name of Browning et al., describes a tree step socket device. The Browning device employs a socket system with modified tree steps.

U.S. Pat. No. 7,258,045, issued in the name of Smith, describes a tree step installation device. The Smith device provides a series of apertures to engage a tree step.

While these devices fulfill their respective, particular objectives, each of these references suffer from one (1) or more of the aforementioned disadvantages. Many such devices are difficult or time consuming to employ. Also, many such devices do not allow the device to be used in multiple rotational directions. Furthermore, many such devices do not help in the initial engagement of the tree step thread with the tree. Also, many such devices do not provide the user adequate gripping means. Accordingly, there exists a need for a tree step installation devices without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a device which allows for the quick, easy, and safe installation of a plurality of tree steps in a manner which is simple and efficient. Thus, the object of the present invention is to solve the aforementioned disadvantages and provide for this need.

To achieve the above objectives, it is an object of the present invention to provide a device which comprises a body, a hammer, portion, a pair of shoulders, a support aperture, a handle, and a strap. The device is utilized in conjunction with a conventional tree step which is used to assist a hunter in climbing a tree in order to gain access to a tree stand or blind.

Another object of the present invention is to comprise an "L"-shaped body to secure the tree step and supply additional torque while inserting or removing the tree step. The body comprises a hammer portion, a pair of shoulders, a support aperture, and a handle aperture.

Yet still another object of the present invention is to attach a conventional tree step to an upper portion of the body and a handle to the lower portion of the body.

Yet still another object of the present invention is for the body to measure approximately twelve (12) inches in length and one (1) inch in width. The body functions similar to a conventional wrench and is fabricated from a flat steel stock that is cut, bent, or punched into the necessary shape, although other materials and methods may be incorporated.

Yet still another object of the present invention is to comprise the upper portion of the device of a pair of shoulders which provide parallel members extending outward in order to secure a vertical portion of the tree step, thereby fixing movements along the X-axis. Each shoulder is fabricated from an identical material as the body. The shoulders are preferably formed during a metal forging process, although other suitable fastening methods may be incorporated without limiting the function of the device.

Yet still another object of the present invention is to provide each shoulder with dimension of approximately one (1) inch in width by one-and-a-quarter (1¼) inch in height, with a gap of approximately one-half (½) inch between for placement of the tree step.

Yet still another object of the present invention is to comprise the upper portion of the device of a through-hole support aperture which encompasses an upper horizontal portion of the inserted tree step to fix the movement of the tree step along the Y-axis. The support aperture expands among two (2) opposing surfaces of the body parallel to the orientation of the handle.

Yet still another object of the present invention is to comprise the support aperture of an innermost diameter measuring approximately seven-sixteenths (7/16) of an inch and an outermost diameter measuring approximately three-fourths (¾) of an inch. The support aperture is preferably formed during a metal forging process, although other suitable methods may be incorporated without limiting the function of the device.

Yet still another object of the present invention is to provide a hammer portion, which comprises an outward protrusion located opposing the shoulders and acts as an impacting means to initially drive the tree step into a tree. The hammer portion is generally fabricated from a similar material as the body.

Yet still another object of the present invention is to comprise the lower portion of the device of a handle, which provides a grippable portion to rotate the body and rotatably insert or remove the tree step into or from a tree. The handle comprises a shaft and a fastener.

Yet still another object of the present invention is for the handle to rotate freely around the shaft. The handle is approximately four-and-three-fourth (4¾) inches in length and preferably fabricated from wood with an anticorrosion finish, although other suitable materials may be incorporated.

Yet still another object of the present invention is to insert the shaft through a handle aperture and body aperture. The shaft is fastened to a threaded end portion with a fastener.

Yet still another object of the present invention is to comprise a distal end portion of the handle of a strap, which provides an attachment means to the user's wrist or the like. The strap comprises a strap adjustment and a strap fastener, and is fabricated from a material such as nylon, cotton, or the like.

Yet still another object of the present invention is to provide a strap adjustment, which comprises a conventional digit operated drawstring synching adjusting means. The strap adjustment is made of a plastic material, although other materials may be incorporated.

Yet still another object of the present invention is to further comprise the strap adjustment of a "T"-shaped thumb grip. The thumb grip depresses an internal spring and aligns an adjustment aperture with a fastener aperture, enabling the strap to be adjusted in length. When released, the thumb grip synchs the strap inside the strap adjustment.

Yet still another object of the present invention is to provide a tether, which comprises a circular member to secure the strap to the handle. The tether is inserted through the shaft prior to insertion through the handle and is fabricated from materials such as plastic, metal, wood, or the like.

Yet still another object of the present invention is to provide a method of utilizing the device that provides a unique means of easily, quickly, and safely engaging tree steps with a tree for the purposes of climbing the tree.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
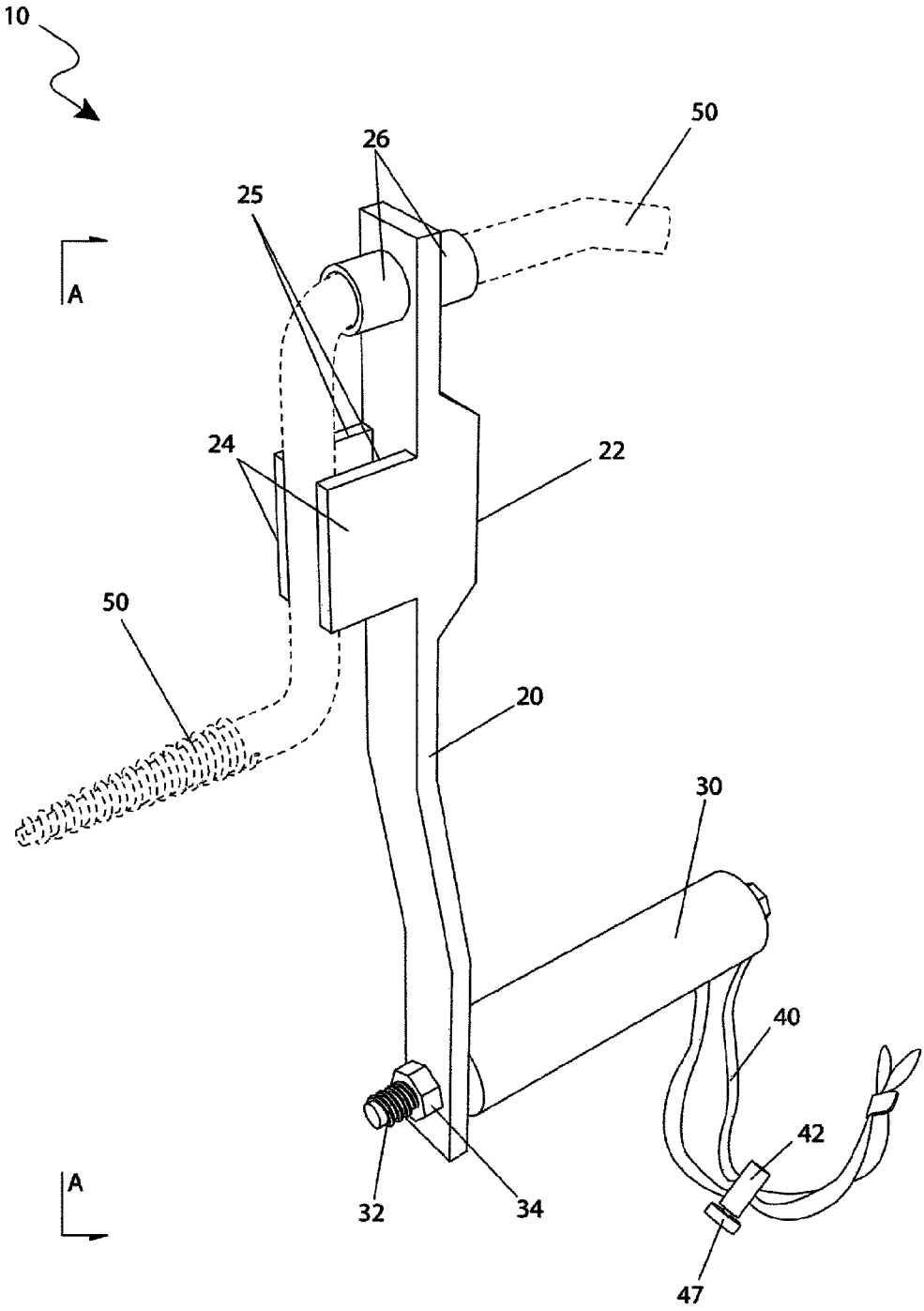
FIG. 1 is a front perspective view of a tree step installation tool 10, according to a preferred embodiment of the present invention.

| | |
|---|---|
| 10 | tree step installation tool |
| 20 | body |
| 21 | body aperture |
| 22 | hammer portion |
| 24 | shoulder |
| 25 | gap |
| 26 | support aperture |
| 29 | handle aperture |
| 30 | handle |
| 32 | shaft |
| 34 | fastener |
| 40 | strap |
| 42 | strap adjustment |
| 44 | strap fastener |
| 45 | spring |
| 46 | adjustment aperture |
| 47 | thumb grip |
| 48 | fastener aperture |
| 49 | tether |
| 50 | tree step |

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a tree step installation tool (herein described as the "device") 10, which provides a tool to assist in the insertion and removal of a tree step 50 thereinto a tree for recreational hunting purposes. Said device 10 comprises a body 20, a hammer portion 22, a pair of shoulders 24, a support aperture 26, a handle 30, and a strap 40. The device 10 is utilized in conjunction with a conventional tree step 50 which is used to assist a hunter in climbing a tree thereto gain access to a tree stand or blind. The use of said device 10 provides hunters who hunt from an elevated platform on trees an effective means of reducing the work involved with the installation and removal of tree steps 50.

Referring now to FIG. 1, a front perspective view of the device 10, according to the preferred embodiment of the present invention, is disclosed. The device 10 comprises an "L"-shaped body 20, thereby securing the tree step 50 and supplying additional torque while inserting or removing the tree step 50. Said body 20 comprises a hammer portion 22, a pair of shoulders 24, a support aperture 26, and a handle aperture 29. A conventional tree step 50 is attached to an upper portion of the body 20 and the handle 30 is attached to a lower portion of the body 20. Said body 20 measures approximately twelve (12) inches in length and one (1) inch in width. Said body 20 functions similar thereto a conventional wrench and is fabricated from a flat steel stock that is cut, bent, or punched into the necessary shape, yet other materials and methods may be incorporated without limiting the functions of the device 10.

The upper portion of the device 10 comprises the pair of shoulders 24, thereby providing parallel members, who extend outwardly, to secure a vertical portion the tree step 50 therein. Said shoulders 24 fix the tree step 50 from movements along the X-axis. Each shoulder 24 protrudes outwardly and measures approximately one (1) inch in width by one-and-a-quarter (1¼) inches in height and forms a gap 25 of approximately one-half (½) an inch, thereby providing placement of the tree step 50. Each shoulder 24 is fabricated from an identical material as the body 20, yet other materials may be incorporated without limiting the functions of the device 10. The shoulders 24 are preferably formed during a metal forging process, yet welding other suitable fastening methods maybe incorporated without limiting the function of the device 10.

The upper portion of the device 10, superjacent to the shoulder 24, comprises a through-hole support aperture 26, thereby encompassing an upper horizontal portion of the inserted tree step 50 and fixing the movement of said tree steps 50 along the Y-axis. Said support aperture 26 expands among two (2) opposing surfaces of the body 20 to define the abovementioned through-hole. Said support aperture 26 is parallel with the orientation of a handle 30 (see FIG. 2). Said support aperture 26 comprises an innermost diameter measuring approximately seven-sixteenths (7/16) of an inch and an outermost diameter measuring approximately three-fourths (¾) of an inch. The support aperture 26, as like the shoulders 24, is preferably formed during a metal forging process, yet other methods maybe incorporated without limiting the function of the device 10.

The device 10 also comprises a hammer portion 22, thereby providing an impacting means thereto initially drive the tree step 50 into a tree. Said hammer portion 22 protrudes outwardly in a generally rectangular form that which takes the form of a common hammer head. Said hammer portion 22 is located opposing the shoulders 24 thereon an upper portion of the device 10. Said hammer portion 22 is also preferably fabricated from a similar material as the body 20.

Figure 2:
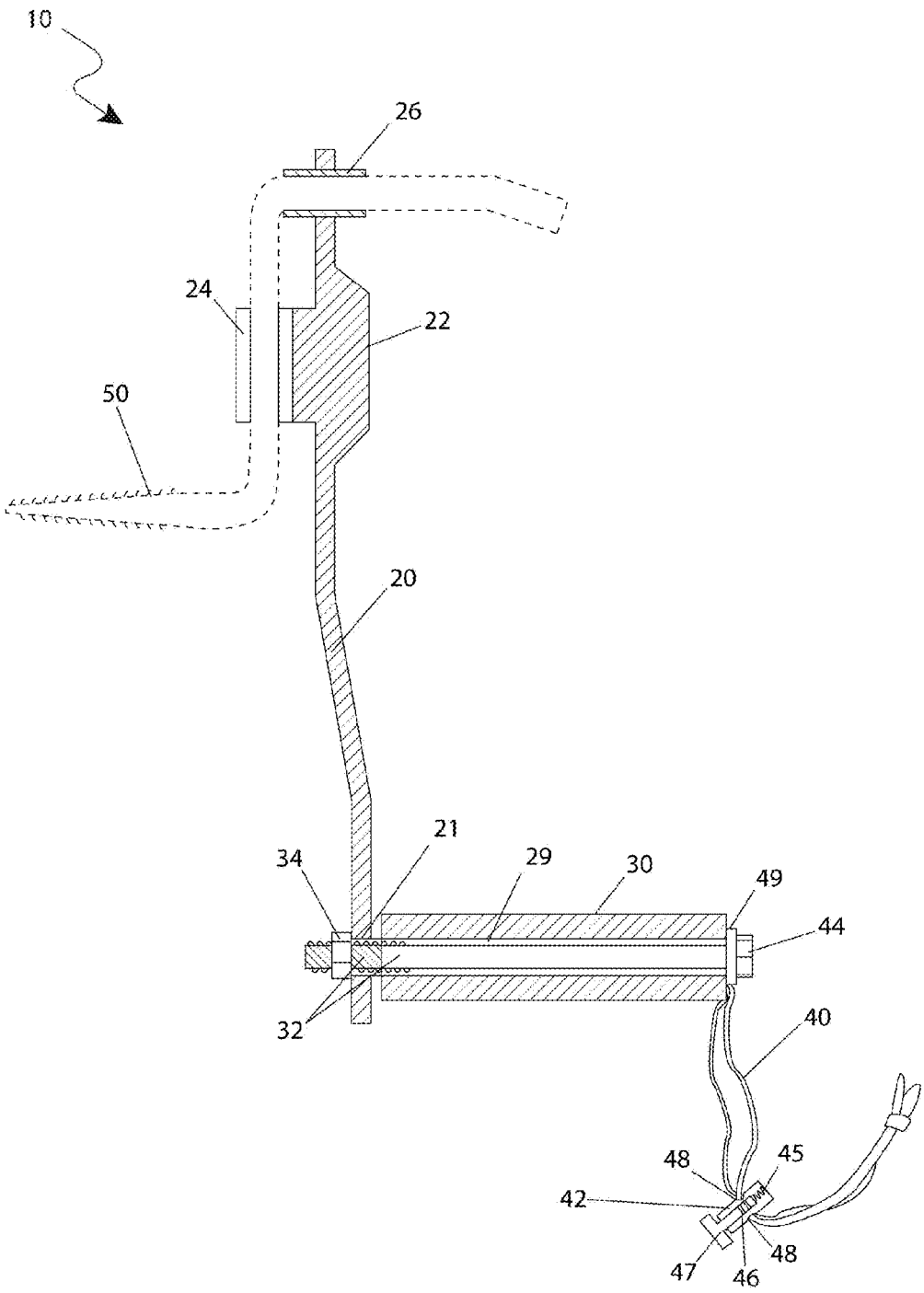
FIG. 2 is a section view of the tree step installation tool 10 taken along line A-A thereon FIG. 1, according to a preferred embodiment of the present invention.

Referring now to FIG. 2, a section view of the device 10 taken along line A-A thereon FIG. 1, according to the preferred embodiment of the present invention, is disclosed. A lower portion of the device 10 comprises a handle 30, thereby providing a grippable portion to rotate the body 20 and in-turn rotatably insert or remove the tree step 50 into or from a tree. The handle 30 comprises a shaft 32 and a fastener 34. The shaft 32 is inserted through a handle aperture 29 and body aperture 21 and fastened thereon a threaded end portion with a fastener 34 which is preferably a common lock-nut, yet other fastening means may be incorporated without limiting the functions of the device 10. The handle 30 freely rotates around the shaft 32, thereby increases the functionality of the device 10. Said handle 30 is approximately four-and-three-fourth (4¾) inches in length and preferably fabricated from wood with an anticorrosion finish, yet other materials may be incorporated such as, but not limited to: metal, plastic, or the like.

A distal end portion of the handle 30 comprises a strap 40, thereby providing an attachment means to the users wrist, hunting sack, or the like. Said strap 40 comprises a strap adjustment 42 and a strap fastener 44. The strap adjustment 42 is a conventional digit operated draw string synching adjusting means similar to draw string adjusters thereon jackets, sweatshirts, pants, or the like. A top "T"-shaped thumb grip 47 thereon the strap adjustment 42 is depressed, thereby depressing an internal spring 45, aligning an adjustment aperture 46 with a fastener aperture 48, and enabling the strap 40 to be adjusted in length. Once the thumb grip 47 is released the spring 45 forces said thumb grip 47 to an original position thus unlinking the apertures 46, 48 and synching the strap 40 thereinside the strap adjustment 42. The strap adjustment 42 is fabricated from a plastic material, yet other materials may be incorporated. The strap 40 is also fastened to the handle 30 therewith a tether 49 which is a circular member to secure the strap 40 to the handle 30. Said tether 49 is inserted through the shaft 32 prior to insertion through the handle 30 and is fabricated from materials such as, but not limited to: plastic, metal, wood, or the like. The strap 40 is fabricated from materials such as, but not limited to: nylon, cotton, or the like.

Figure 3:
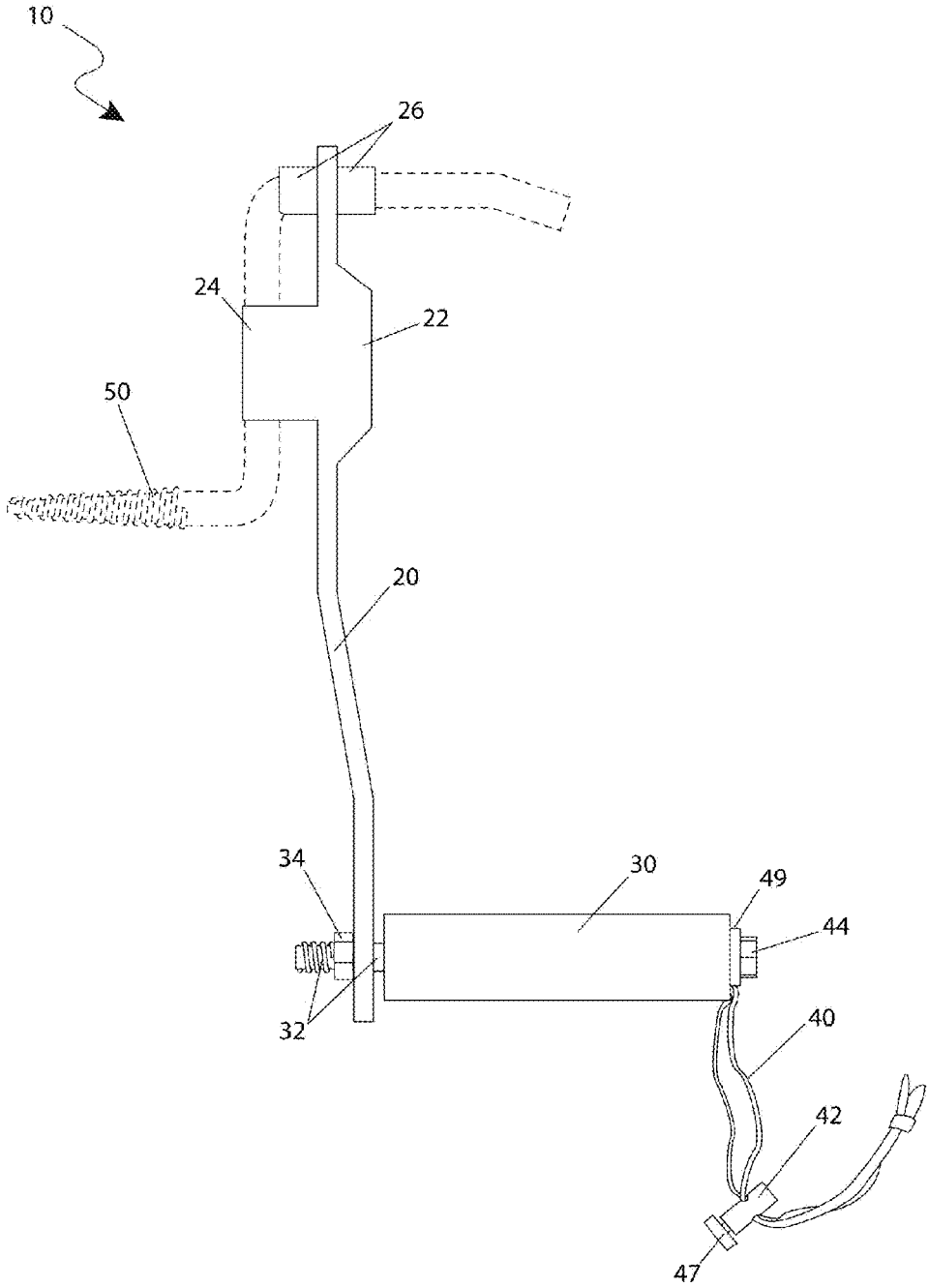
FIG. 3 is a front view of the tree step installation tool 10, according to a preferred embodiment of the present invention.
Figure 4:
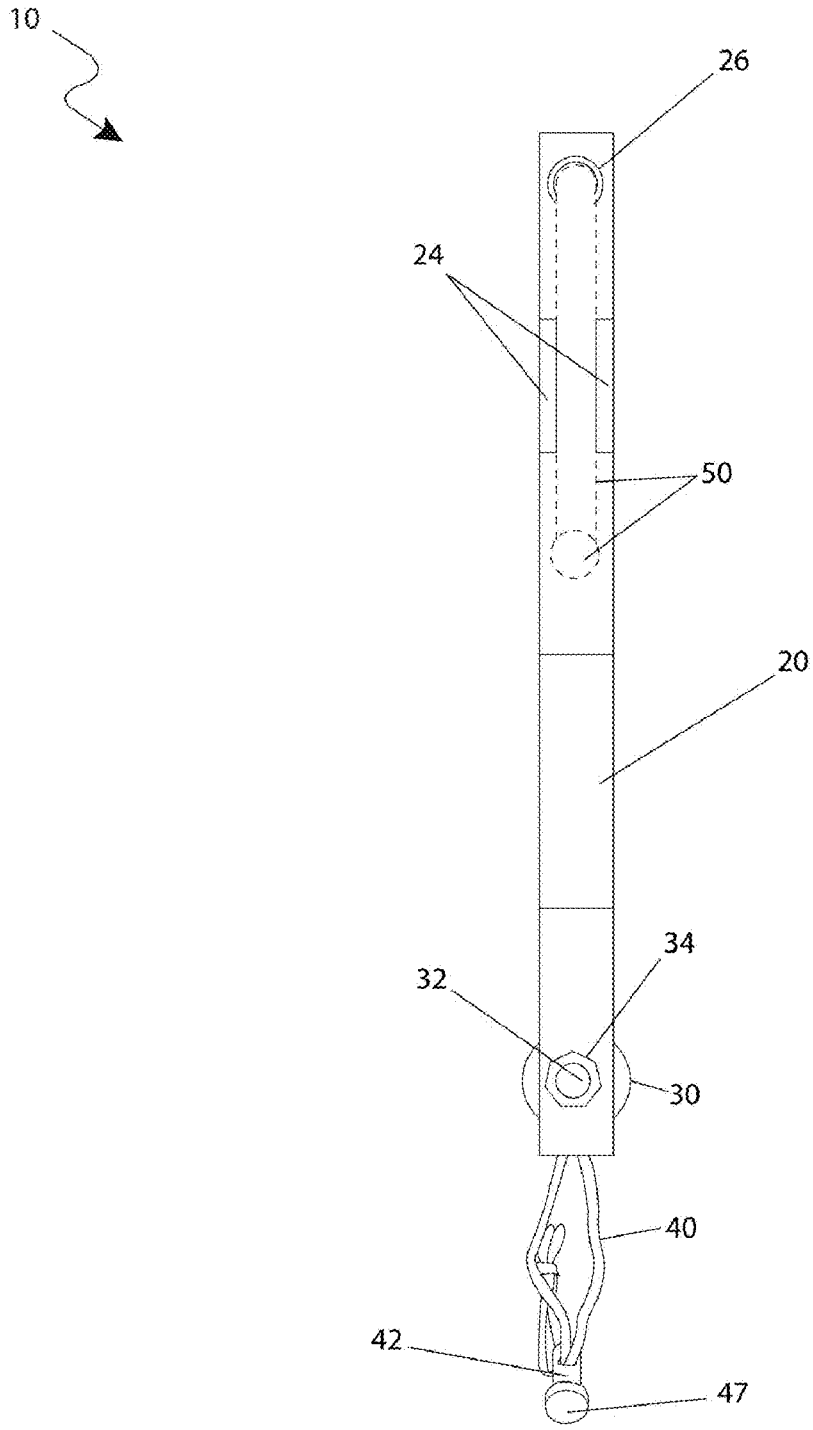
FIG. 4 is a side view of the tree step installation tool 10, according to a preferred embodiment of the present invention.
Figure 5:
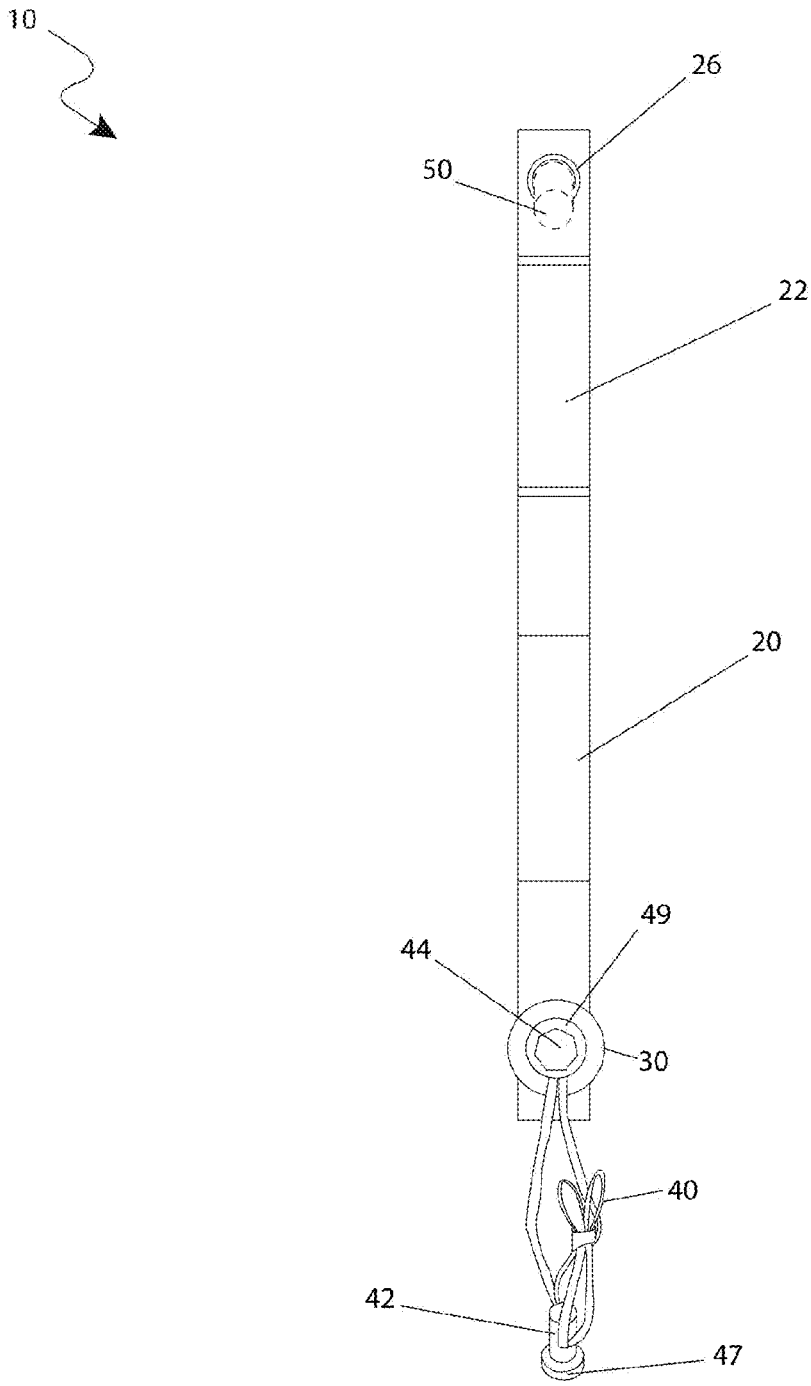
FIG. 5 is an opposing side view of the tree step installation tool 10, according to a preferred embodiment of the present invention.
Figure 6:
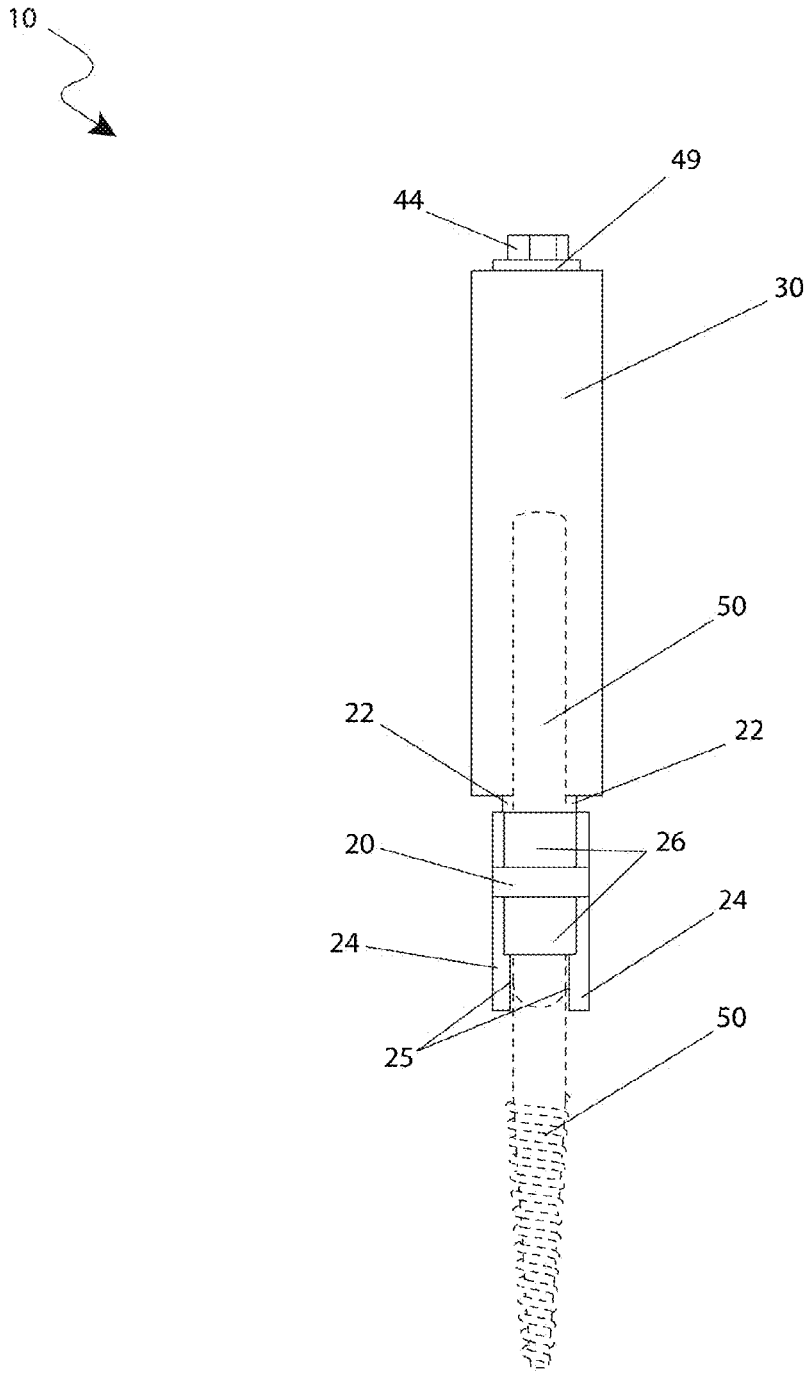
FIG. 6 is a top view of the tree step installation tool 10, according to a preferred embodiment of the present invention; and, FIG. 7 is a bottom view of the tree step installation tool 10, according to a preferred embodiment of the present invention.
Figure 7:
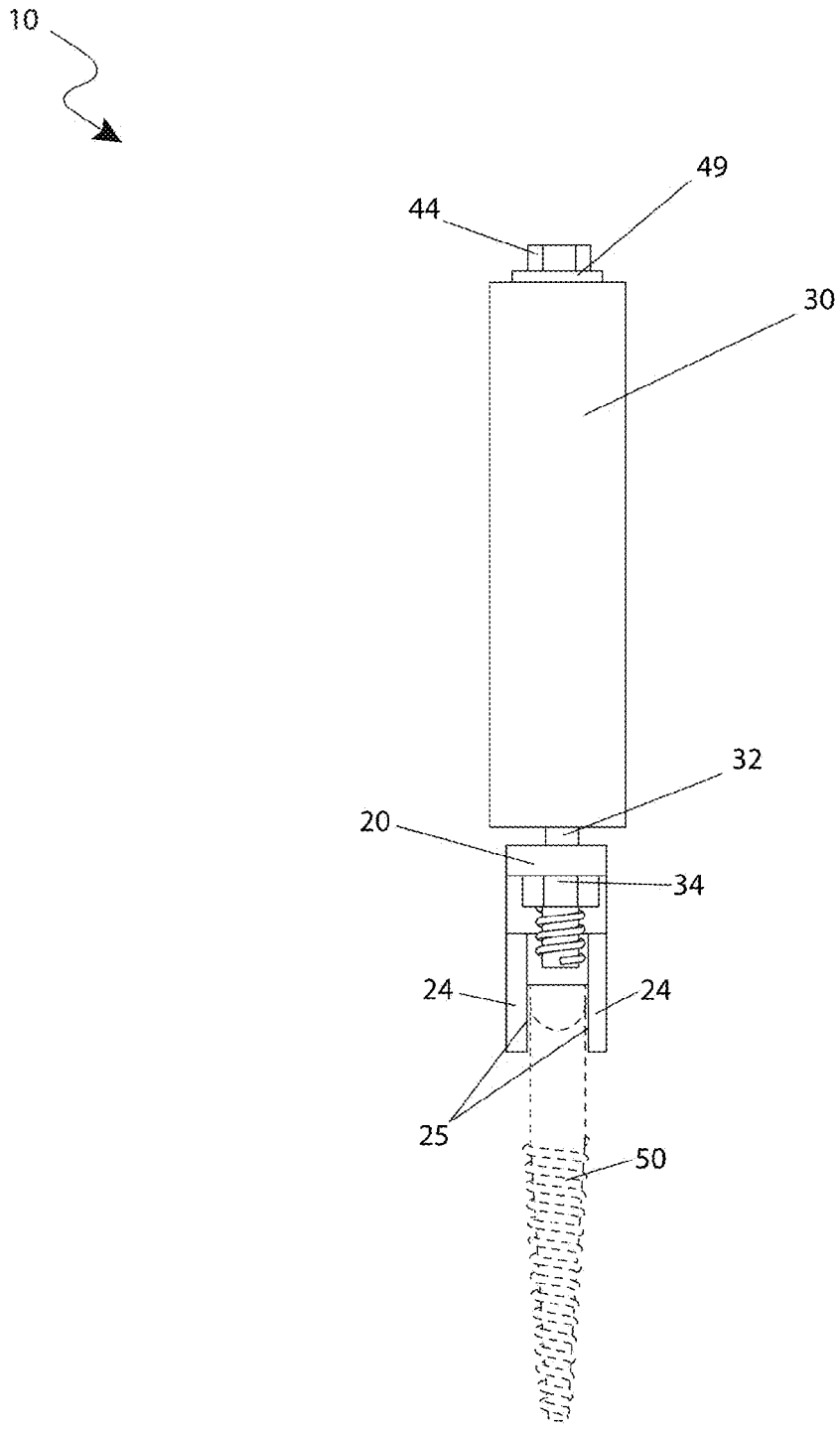

Referring now to FIG. 3 through FIG. 7, various views of the device 10, according to the preferred embodiment of the present invention, are disclosed. FIG. 3 depicts a front view, FIG. 4 depicts a side view, FIG. 5 depicts an opposing side view, FIG. 6 depicts a top view, and FIG. 7 depicts a bottom view.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: acquiring the device 10; utilizing the hammer portion 22 to drive the pointed portion of a tree step 50 into a tree, thereby creating an initial starting position as necessary; positioning a vertical portion of the tree step 50 therebetween the shoulders 24 and inserting a horizontal portion of said tree step 50 through the support aperture 26; inserting the tree step 50 into the tree or previously hammered initial starting position thereon the tree; gripping the handle 30 and rotating the device 10 to insert the tree step 50 into the tree until the tree step 50 is inserted to a desired depth; removing the device 10 from the tree step 50; repeating as necessary; reinserting the tree step 50 in the device 10 as abovementioned; gripping the handle 30 and rotating the device 10 in an opposite direction from the inserting step, thereby removing the tree step 50 from the tree; repeating as necessary; attaching the strap 40 at a desired location to store or wear the device 10; utilizing the strap adjustment 42 to adjust the length of the strap 40; and, enjoying the reduced work involved for inserting tree steps 50 into trees.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A tool for inserting and removing a step into a tree, comprising:

a body for securing said step, comprising a bar further comprising:

a first end forwardly offset from said second end to provide a clearance for said body during inserting and removing said step therein said tree, further comprising a front surface and a rear surface;

a support aperture for securing said step therein, located at said first end and projecting outwardly from said front surface and said rear surface of said bar at equidistant lengths, thereby resisting said step from movement about a y-axis during inserting or removing said step therein said tree;

a pair of shoulders located subjacent thereto said support aperture and extending outwardly therefrom said front surface thereof said bar and defining a gap between, thereby securing a vertical portion of said step therein said gap and resisting said step from movement about an x-axis during installation or removal;

a hammer portion protruding outwardly therefrom said rear surface of said bar opposite of said pair of shoulders, thereby providing an impacting means to initially drive said step into said tree; and, a body aperture located at said second end; and, a handle assembly removably attached thereto said body at said body aperture such that said handle assembly is oriented parallel thereto said support aperture, further comprising:

a threaded shaft, comprising a proximal end inserted therein said body aperture located at said second end of said body, comprising a proximal end and a distal end;

a handle disposed along said shaft such that said handle freely rotates around said shaft; and, a pair of fasteners fastening said proximal end of said threaded shaft thereto said body aperture and said distal end thereto said handle;

wherein said tool provides an assisting means for inserting and removing said step therein said tree;

wherein said tool provides additional torque for inserting and removing said step therein said tree; and, wherein said handle assembly provides a gripping means for rotating said body with said step secured therein for inserting and removing said step therein said tree.

2. The tool of claim 1, wherein said bar is approximately twelve inches in length and one inch in width.

3. The tool of claim 1, wherein said support aperture further comprises an inner diameter of approximately seven-sixteenths of an inch and an outer diameter of approximately three-fourths of an inch.

4. The tool of claim 1, wherein each of said pair of shoulders comprises a width of approximately one inch in width and a height of approximately one-and-a-quarter inches, such that said gap comprises a width of approximately one-half inch.

5. The tool of claim 1, wherein said handle assembly further comprises a wooden construction having a length of approximately four-and-three-fourth inches and said body comprises a metallic construction.

6. The tool of claim 1, further comprising an adjustable strap tethered thereto said distal end of said threaded shaft.

7. A method for inserting a step into a tree comprises the following steps:

providing a tool, said tool further comprising:

a body for securing said step, comprising a bar further comprising:

a first end forwardly offset from said second end to provide a clearance for said body during inserting and removing said step therein said tree, further comprising a front surface and a rear surface;

a support aperture for securing said step therein, located at said first end and projecting outwardly from said front surface and said rear surface of said bar at equidistant lengths, thereby resisting said step from movement about a y-axis during inserting or removing said step therein said tree;

a pair of shoulders located subjacent thereto said support aperture and extending outwardly therefrom said front surface thereof said bar and defining a gap between, thereby securing a vertical portion of said step therein said gap and resisting said step from movement about an x-axis during installation or removal;

a hammer portion protruding outwardly therefrom said rear surface of said bar opposite of said pair of shoulders, thereby providing an impacting means to initially drive said step into said tree; and, a body aperture located at said second end; and, a handle assembly removably attached thereto said body at said body aperture such that said handle assembly is oriented parallel thereto said support aperture, further comprising:

a threaded shaft, comprising a proximal end inserted therein said body aperture located at said second end of said body, comprising a proximal end and a distal end;

a handle disposed along said shaft such that said handle freely rotates around said shaft; and, a pair of fasteners fastening said proximal end of said threaded shaft thereto said body aperture and said distal end thereto said handle; and, an adjustable strap tethered thereto said distal end of said threaded shaft;

inserting a hand through said strap and adjusting said strap to a secure position;

utilizing said hammer portion to strike said step in order to drive a pointed portion of said step into said tree, thereby creating an initial starting position;

positioning a vertical portion of said step therein said gap between said pair of shoulders and inserting a horizontal portion of said step through said support aperture;

inserting said step into said tree at said initial starting position;

gripping said handle and rotating said tool in a first direction to insert said step into said tree until said step is inserted to a desired depth; and, removing said tool from said step.

8. The method of claim 7, further comprising the steps of:

removing said step from said tree by positioning said vertical portion of said step therein said gap between said pair of shoulders and inserting said horizontal portion of said step through said support aperture;

gripping said handle and rotating said tool in a second direction to remove said step from said tree; and, removing said tool from said step.

* * * * *